US005284086A

United States Patent [19]

Wang et al.

[11] Patent Number: 5,284,086

[45] Date of Patent: Feb. 8, 1994

[54] MECHANISM FOR CRUSHING CANS

[76] Inventors: Chao-Chia Wang; Chuan-Cheng Chen, both of No. 439, Ho Ping Rd., Ta Chia Chen, Taichung Hsien, Taiwan

[21] Appl. No.: 17,472

[22] Filed: Feb. 12, 1993

[51] Int. Cl.[5] ..... B30B 1/04; B30B 9/32

[52] U.S. Cl. ..... 100/102; 100/103; 100/215; 100/283; 100/902

[58] Field of Search ..... 100/100, 102, 103, 215, 100/245, 283, 293, 902

[56] References Cited

U.S. PATENT DOCUMENTS

| | | | |
|---|---|---|---|
| 99,256 | 1/1870 | Squires et al. | 100/100 |
| 278,245 | 5/1883 | Lesher | 100/102 |
| 817,011 | 4/1906 | Smith | 100/102 X |
| 2,128,630 | 8/1938 | Wright | 100/902 X |
| 2,353,221 | 7/1944 | Clifton et al. | 100/215 X |
| 2,630,752 | 3/1953 | Casella et al. | 100/283 X |
| 3,765,323 | 10/1973 | Hix | 100/100 |
| 4,519,308 | 5/1985 | Eberle | 100/102 |

FOREIGN PATENT DOCUMENTS

| | | | |
|---|---|---|---|
| 2346147 | 10/1977 | France | 100/902 |
| 57-149098 | 9/1982 | Japan | 100/902 |
| 2011302 | 7/1979 | United Kingdom | 100/215 |
| 2041776 | 9/1980 | United Kingdom | 100/215 |

*Primary Examiner*—Stephen F. Gerrity
*Attorney, Agent, or Firm*—Hedman, Gibson & Costigan

[57] ABSTRACT

A mechanism for crushing cans includes a base, a housing disposed on the front portion of the base and having a panel, a slide slidably engaged in the housing and moveable toward the panel. The cans to be crushed are disposed in the housing and disposed in a position located between the slide and the panel. A pair of levers are pivotally coupled to the base and coupled to the slide, the can is crushed when the slide moves toward the panel.

8 Claims, 5 Drawing Sheets

MECHANISM FOR CRUSHING CANS

BACKGROUND OF THE INVENTION

1. Field of the Invention

The present invention relates to a mechanism, and more particularly to a mechanism for crushing cans and for acting as an exercise mechanism.

2. Description of the Prior Art

Various kinds of mechanisms for crushing cans have been developed, however, most of them are suitable for crushing cans only and can not be used as an exercise mechanism; on the contrary, various kinds of exercise mechanisms have been developed, however, most of them are suitable for practicing exercises only and can not be used as a mechanism for crushing cans.

The present invention has arisen to mitigate and/or obviate the afore-described disadvantages of the conventional exercise mechanisms and mechanisms for crushing cans.

SUMMARY OF THE INVENTION

The primary objective of the present invention is to provide a mechanism which can be used as a mechanism for crushing cans and can be used as an exercise mechanism.

In accordance with one aspect of the invention, there is provided a mechanism for crushing cans comprising a base including a rear portion having a seat disposed thereon and a front portion having a housing disposed thereon, the housing including a panel disposed thereon and located closer to the seat, a slide slidably engaged in the housing and moveable toward and away from the panel, the cans to be crushed being disposed in the housing and disposed in a position located between the slide and the panel, and means for moving the slide, whereby, the can is crushed when the slide moves toward the panel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
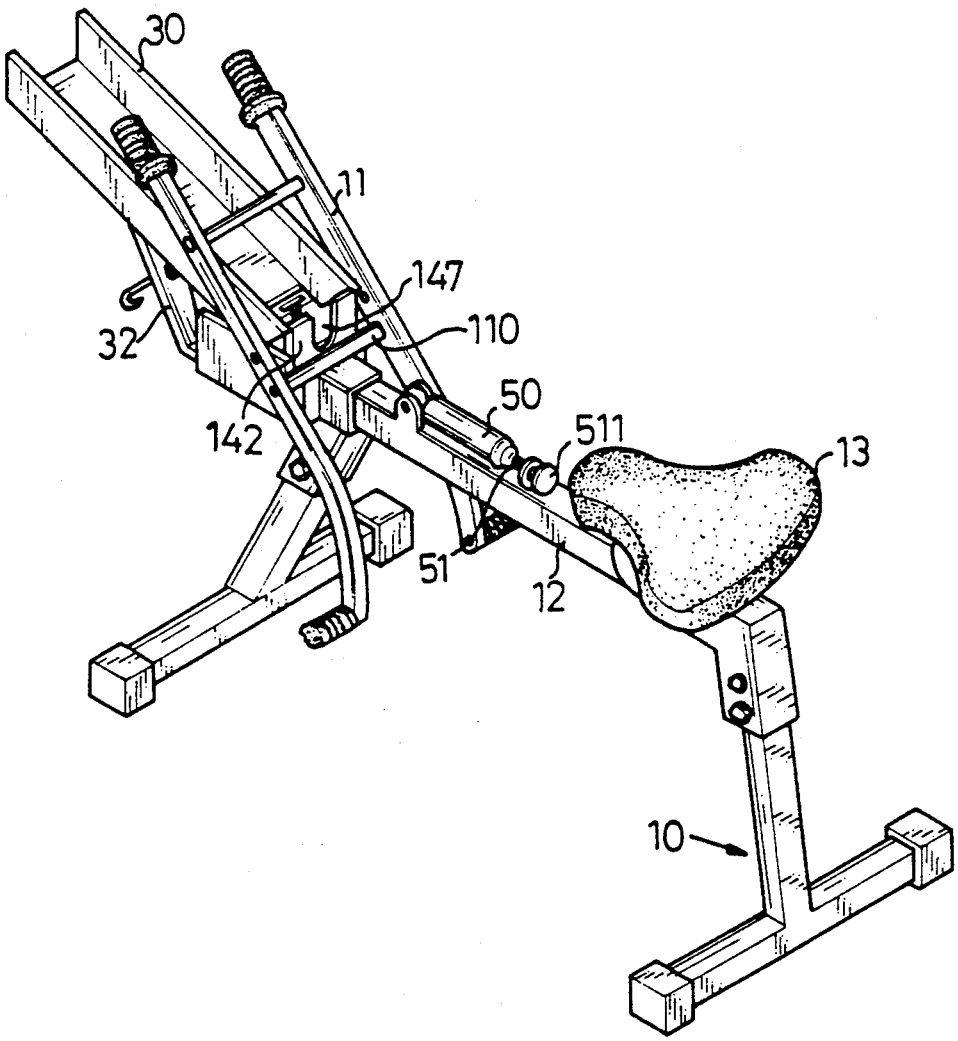
FIG. 1 is a perspective view of a mechanism in accordance with the present invention.
Figure 2:
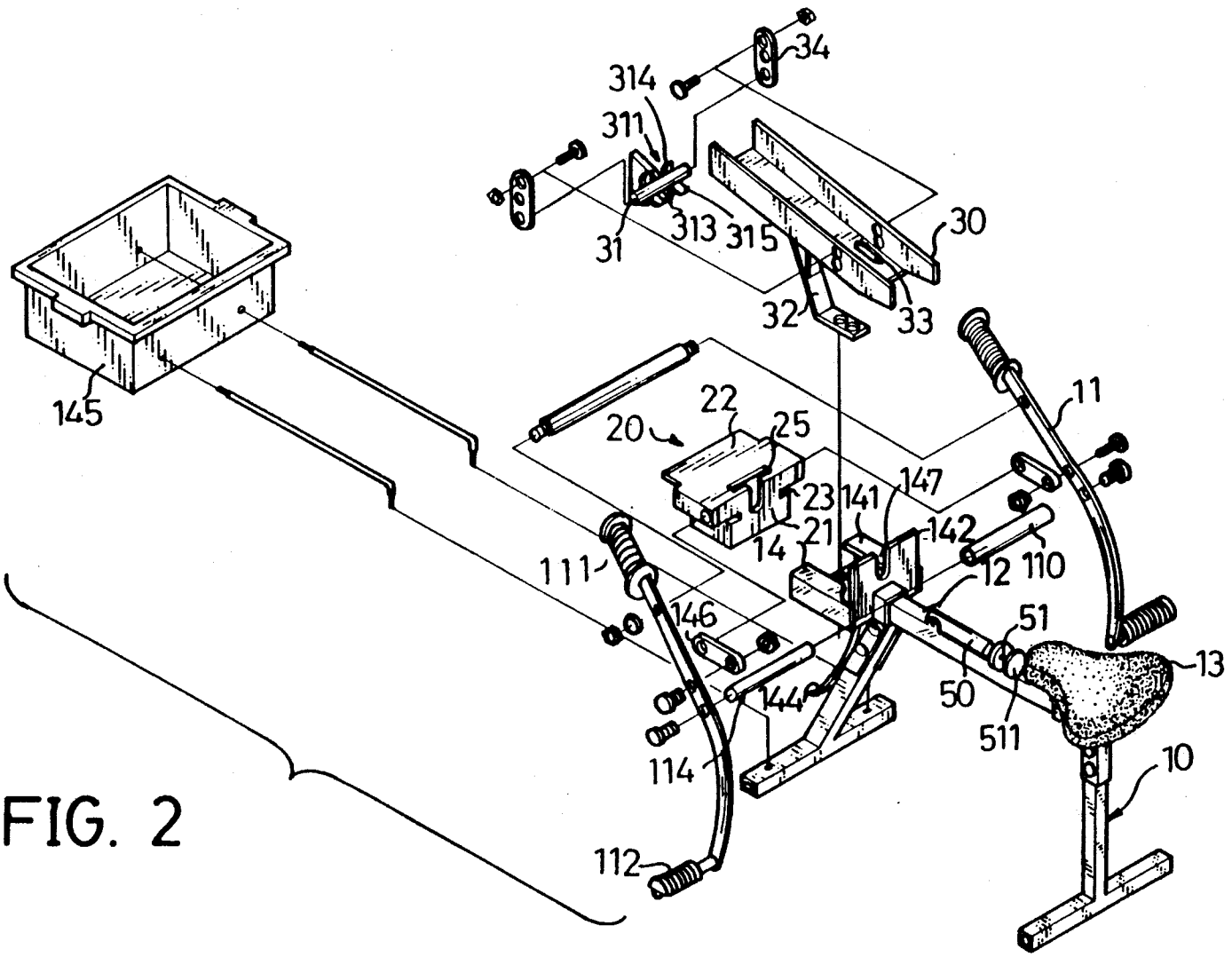
FIG. 2 is an exploded view of the mechanism.
Figure 3:
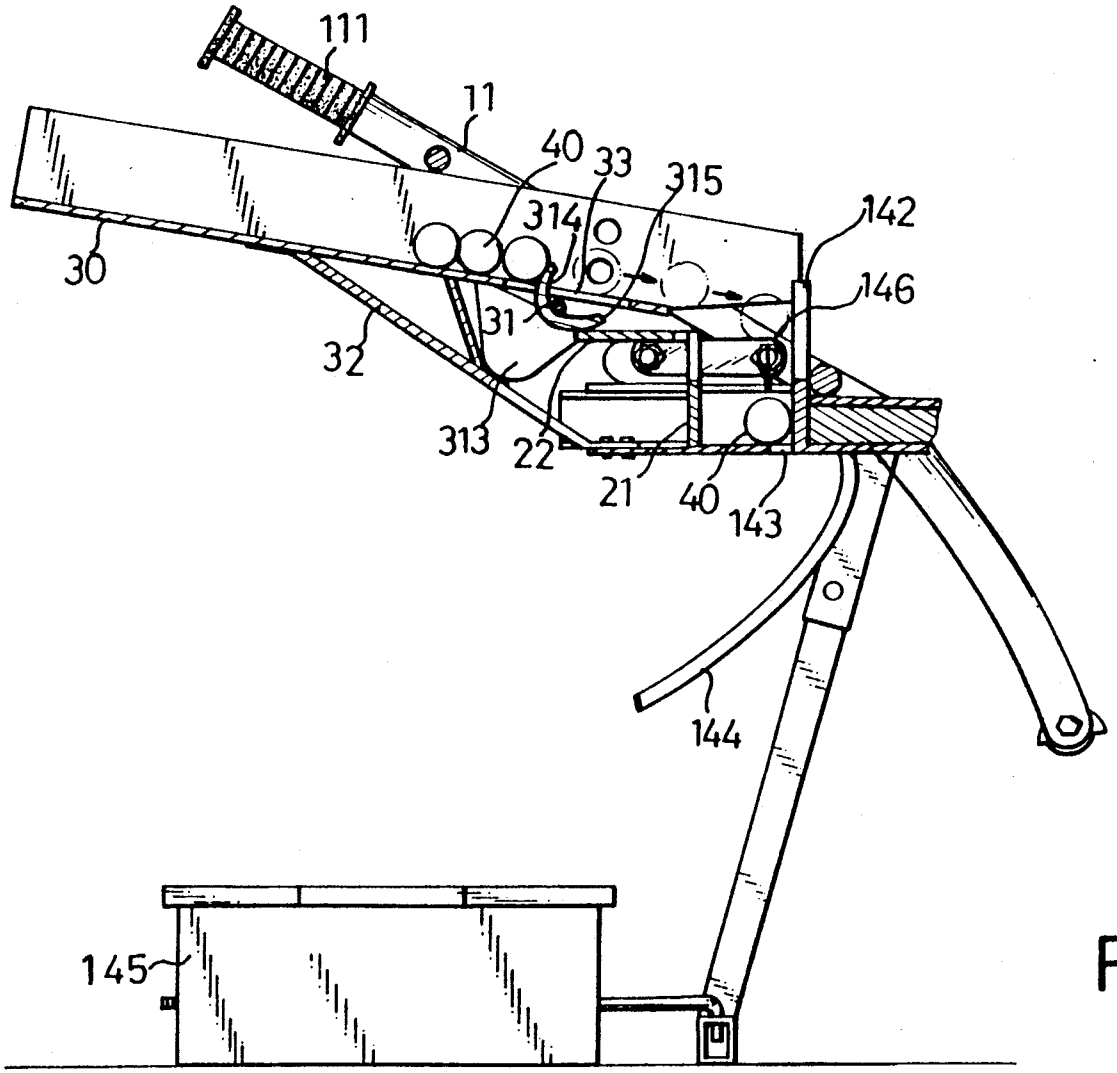
FIGS. 3 and 4 are partial cross sectional views illustrating the operations of the mechanism for crushing cans.

Referring to the drawings, and initially to FIGS. 1 to 3, a mechanism in accordance with the present invention comprises a base 10 including a bar 12 provided in an upper portion thereof, a seat 13 disposed on a rear portion of the bar 12, an actuator 50 pivotally secured on the middle portion of the bar 12 and includes a head 511 formed in the free end portion of the piston rod 51 thereof, a tube 110 fixed on the front portion of the bar 12, a shaft 114 rotatably supported in the tube 110, a pair of levers 11 having a middle portion fixed to the shaft 114, each of the levers 11 including a hand grip 111 formed in the upper portion and a foot pedal 12 provided in the lower portion thereof. A link 146 includes one end pivotally coupled to each of the levers 11.

Figure 4:
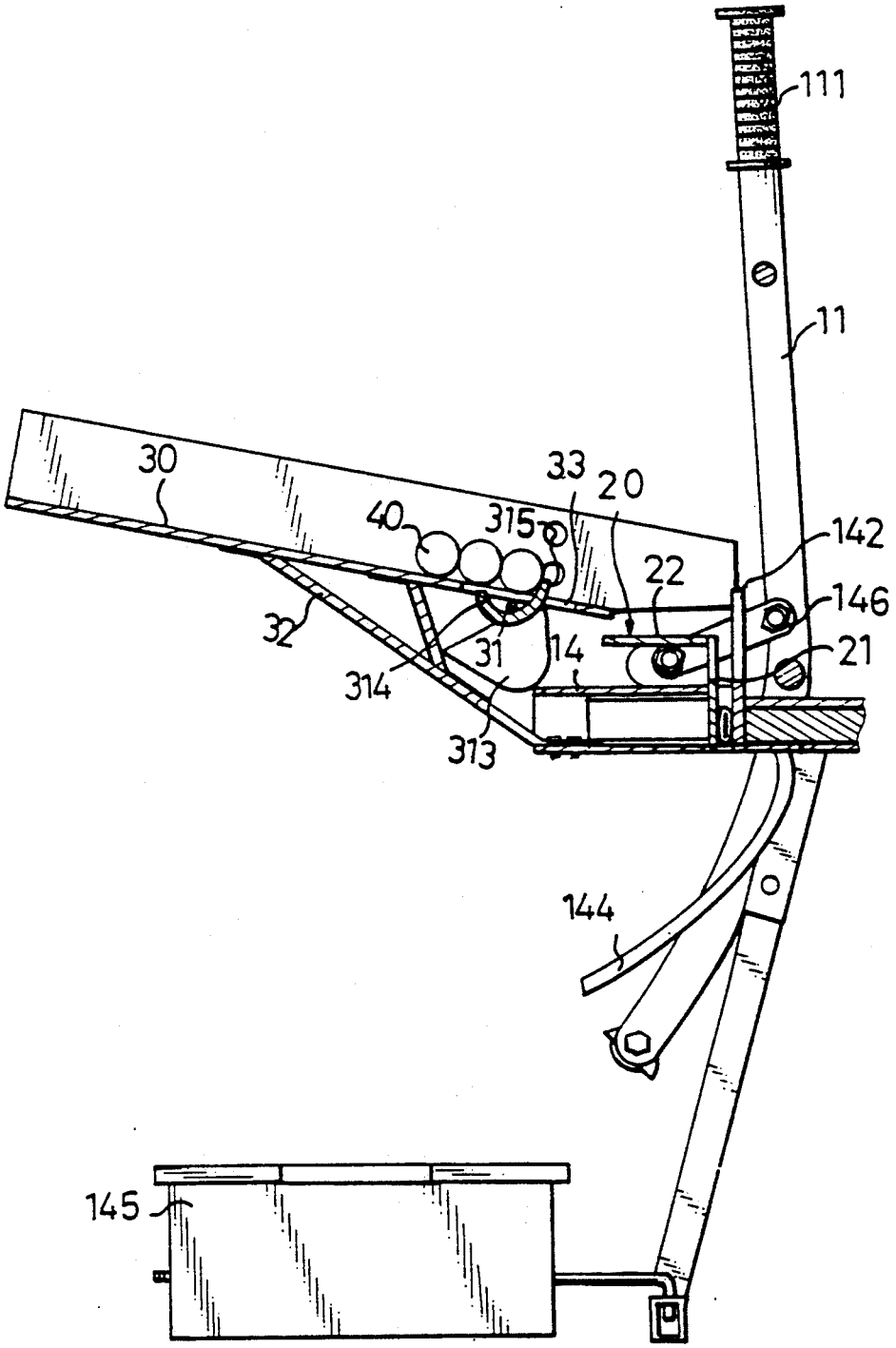

A housing 14 is disposed on the front portion of the bar 12 and located further forward of the tube 110 and includes a pair of flanges 141 extended inwards of the housing 14, a panel 142 extended upward from the rear portion of the housing 14 and located beside the tube 110, an opening 143 (FIG. 3) formed in the bottom portion of the housing 14 and located beside the panel 142, it is to be noted that the cans 40, before crushed, have a diameter larger than that of the opening 143 such that the cans 40 can not move through the opening 143, however, when the cans 40 are crushed, the crushed cans may move through the opening 143 (FIG. 4), a guide element 144 fixed to the bar 12 and located below the opening 143 of the housing 14 for guiding the crushed cans, a container 145 disposed below the guide element 144 for collecting the crushed cans, a depression 147 formed in the upper portion of the panel 142.

A slide 20 includes a pair of grooves 23 formed therein for slidably engaging with the flanges 141 of the housing 14 such that the slide 20 is moveable toward and away from the panel 142, the slide 20 includes a plate 21 moveable toward the panel 142 for crushing the cans disposed between the plate 21 and the panel 142, best shown in FIG. 3, and includes a top 22, a notch 25 formed in the abutment portion of the top 22 and the plate 21. The other ends of the links 146 are pivotally coupled to the slide 20 such that the slide 20 can be moved toward or away from the panel 142 when the levers 11 are rotated about the shaft 114 by the users. It is to be noted that the users may rotate the levers 11 either by pulling the hand grips 111 with hands or by pushing the foot pedals 112 with feet, such that the cans can be crushed while the users do exercise.

Figure 5:
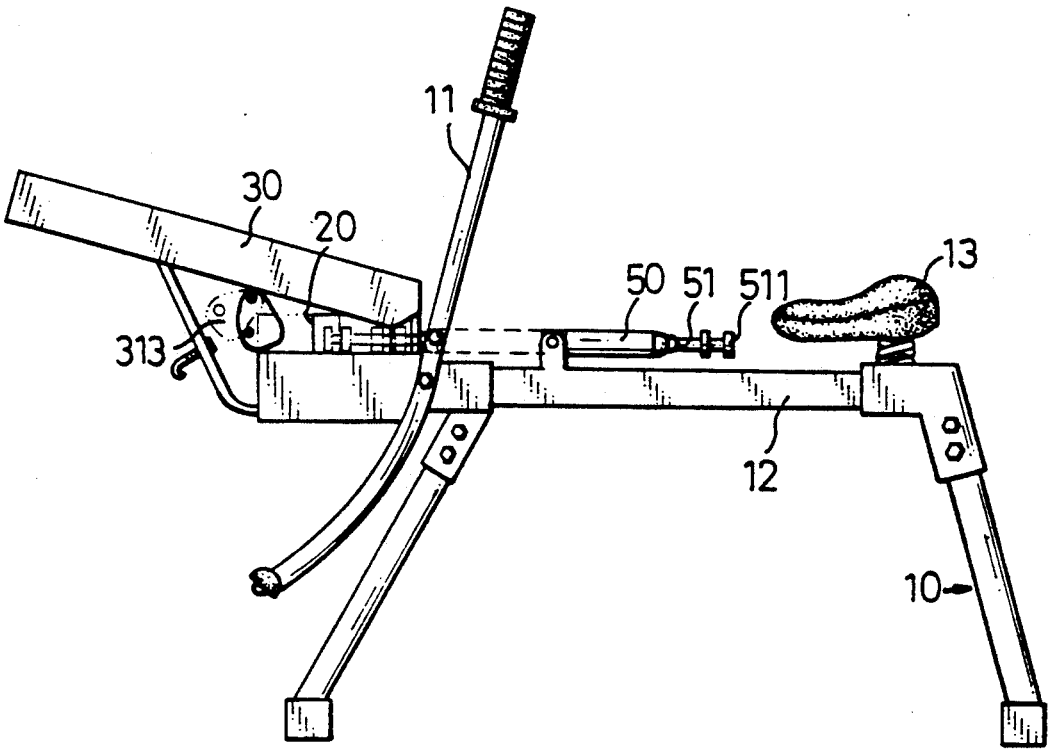
FIG. 5 is a schematic view illustrating the application of the mechanism as an exercise mechanism.

Referring next to FIG. 5, when no cans are to be crushed, the head 511 of the actuator 50 may extend through the depression 147 of the panel 142 and can be engaged in the notch 25 of the slide 20 such that the slide 20 can be coupled to the actuator 50 and such that the users have to overcome the resistant force of the actuator 50 when moving the levers 11, whereby, the users may also do exercise when no cans are to be crushed.

Referring again to FIGS. 1 to 4, a guide channel 30 for receiving cans 40 to be crushed includes a truss 32 provided in the bottom portion and fixed to the housing 14 in order to secure the guide channel 30 above the housing 14 and arranged such that the cans 40 can be guided to the position located between the panel 142 and the plate 21 of the slide 20. The channel 30 includes a hole 33 formed in the lower portion, an axle 31 is rotatably coupled to the guide channel 30 by a pair of ears 34, a stop 311 and a weight 313 are fixed to the axle 31 and rotated in concert with the axle 31, the stop 311 is curved including two ends 314, 315 moveable upward through the hole 33 of the channel 30 when the axle 31 rotates, best shown in FIGS. 3 and 4, so as to stop the cans 40. As shown in FIG. 3, when the slide 20 moves away from the panel 142, the weight 313 is pushed by the slide 20 such that the end 314 moves upward through the hole 33 in order to stop the cans 40; however, when the slide 20 moves toward the panel 142, the weight 313 is no longer acted by the slide 20 and arranged such that the other end 315 moves upward through the hole 33 in order to stop the cans 40. When the slide 20 moves away from the panel 142, the end 314 moves upward again to stop the cans 40, at this moment, the lowest can 40 which contacts the end 315 may move downward to the position located between the panel 142 and the plate 21 of the slide 20 and can be crushed when the slide 20 moves toward the panel 20 again.

Accordingly, the mechanism in accordance with the present invention is applicable both as an exercise mechanism and as a mechanism for crushing cans.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mechanism for crushing cans comprising a base including a rear portion having a seat disposed thereon on which a user sits and a front portion having a housing disposed thereon, said housing including a panel disposed thereon to stop a can to be crushed, a slide slidably engaged in said housing and movable toward and away from said panel, said can to be crushed being disposed in said housing and disposed in a position located between said slide and said panel and thus crushed therebetween when said slide moves toward said panel, and means for moving said slide, including a pair of levers pivotally coupled to said base, and means for coupling said slide to said levers.

2. A mechanism according to claim 1, wherein said base has a longitudinal axis and includes a tube extending in a direction perpendicular to the longitudinal axis, a shaft being rotatably supported in said tube and having two ends respectively connected to said levers to pivot therewith, each of said levers including an upper end and a lower end, a hand grip and a foot pedal being respectively provided on said upper and lower portions of each said lever.

3. A mechanism according to claim 1, wherein said housing includes a bottom surface with an opening to allow the crushed can to pass therethrough.

4. A mechanism according to claim 3, wherein said base includes a guiding element fixed thereto and located below said opening of said housing for guiding said crushed can which has passed through said opening.

5. A mechanism according to claim 1, wherein said housing includes a pair of flanges extended inward thereof, said slide includes a pair of grooves formed therein for slidably engaging with said flanges of said housing, whereby, said slide is guided to slide along said flanges.

6. A mechanism according to claim 1 further comprising a channel disposed above said housing for receiving said cans to be crushed and for guiding said cans to said position located between said slide and said panel.

7. A mechanism according to claim 6, wherein said channel includes a lower portion having a hole formed therein, an axle rotatably secured to said channel and located below said channel, a stop and a weight fixed to said axle, said stop including two ends moveable upward through said hole of said channel in order to stop said cans received in said channel when said axle rotates, a first of said ends of said stop being moved upward to stop said cans by said weight, and a second of said ends being moved upward to stop said cans when said weight is moved by said slide and when said slide moves away from said panel, and one of said cans being moved downward along said channel when said second end of said stop moves upward through said hole of said channel.

8. A mechanism comprising:

a base including a rear portion having a seat disposed thereon on which a user sits and a front portion having a housing disposed thereon, said housing including a panel disposed thereon and located closer to said seat;

a slide slidably engaged in said housing and movable toward and away from said panel, said slide including a notch formed therein;

means for moving said slide, including a pair of levers pivotally coupled to said base, and means for coupling said slide to said levers; and an actuator pivotally secured on said base and including a piston rod having ahead provided thereon, said actuator being selectively located in first and second positions;

whereby when in said first position, said head of said piston rod engages with said notch in said slide, said actuator acts as a resistance means to allow the user to exercise when operating said levers; and when in said second position, said head of said piston rod disengages with said notch in said slide, said panel and said slide define a space therebetween for a can, whereby said can is stopped by said panel and crushed between said panel and said slide when said slide moves toward said panel in response to a motion of said levers.

* * * * *